US009428296B2

(12) United States Patent
Boukobza

(10) Patent No.: US 9,428,296 B2
(45) Date of Patent: Aug. 30, 2016

(54) STRENGTHENED PETALOID BASE OF A CONTAINER

(75) Inventor: Michel Boukobza, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 140 days.

(21) Appl. No.: 13/581,667

(22) PCT Filed: Apr. 15, 2011

(86) PCT No.: PCT/FR2011/050872

§ 371 (c)(1),
(2), (4) Date: Nov. 8, 2012

(87) PCT Pub. No.: WO2011/131893

PCT Pub. Date: Oct. 27, 2011

(65) Prior Publication Data

US 2013/0043255 A1 Feb. 21, 2013

(30) Foreign Application Priority Data

Apr. 21, 2010 (FR) ..... 10 01704

(51) Int. Cl.
*B65D 90/14* (2006.01)
*B65D 1/02* (2006.01)

(52) U.S. Cl.
CPC ..... *B65D 1/0284* (2013.01)

(58) Field of Classification Search
USPC ..... 215/370–377; 220/606, 608, 610
See application file for complete search history.

(56) References Cited

U.S. PATENT DOCUMENTS

| | | | | |
|---|---|---|---|---|
| 5,353,954 | A * | 10/1994 | Steward et al. | 220/608 |
| 5,785,197 | A * | 7/1998 | Slat | 215/375 |
| 7,686,178 | B2 * | 3/2010 | Grant et al. | 215/384 |
| 2008/0223816 | A1 * | 9/2008 | Darr et al. | 215/382 |

FOREIGN PATENT DOCUMENTS

EP 1 795 328 A1 6/2007

* cited by examiner

*Primary Examiner* — J. Gregory Pickett
*Assistant Examiner* — Allan Stevens
(74) *Attorney, Agent, or Firm* — Sughrue Mion, PLLC

(57) ABSTRACT

Container (1) of thermoplastic material produced by blowing or stretch blowing of a blank, said container comprising a petaloid bottom (3) provided with projecting feet (4) separated by hollow valleys (8) that extend radially from a central zone (5) of the bottom (3), each foot (4) having two flanks (9), each of which laterally borders a valley (8). Each foot (4) is provided, on each of its flanks (9), with a cheek (18) that projects laterally from the side of the valley (8).

8 Claims, 3 Drawing Sheets

STRENGTHENED PETALOID BASE OF A CONTAINER

CROSS REFERENCE TO RELATED APPLICATIONS

This application is a National Stage of International Application No. PCT/FR2011/050872 filed on Apr. 15, 2011, claiming priority based on French Patent Application No. FR10/01704 filed Apr. 21, 2010, the contents of all of which are incorporated herein by reference in their entirety.

The invention relates to the manufacture of containers, particularly bottles, obtained by blowing or stretch blowing from blanks (preforms or intermediate containers) made of thermoplastic material.

A container generally comprises an open neck, by which the contents are introduced (generally a liquid or a paste), a body, which gives the container its volume, and a bottom, which closes the body opposite the neck and forms a base intended to hold the container upright when it is placed on a surface.

Generally means are sought to rigidify the bottom to make it resistant, depending on the case:

- to the hydrostatic pressure exerted by the contents;
- for hot-filling applications, to the thermal stresses induced by the high temperature of the contents, said temperature being able to exceed the glass transition temperature of the material of which the container is made (for example, many containers made of PET, the glass transition temperature of which is about 80° C., can be filled with liquids whose temperature is close to or exceeds 90° C.);
- for gaseous applications, to the mechanical stresses due to the pressure of the dissolved gas in the liquid (such as beer, for example).

Moreover, these applications can be combined. Some carbonated liquids can be hot filled, or undergo pasteurization that increases both the temperature (and thus the volume) of the liquid as well as the pressure of the heated dissolved gas. In some particular hot-filling applications, called "nitrogen HR," a drop of liquid nitrogen is placed in the container after filling and before capping. This is intended, after vaporization, to maintain the void volume under pressure (located in the neck, above the liquid), thus avoiding excessive retraction of the container during the cooling of the liquid.

In all of these cases, the bottom must be particularly mechanically strong, and generally a petaloid shape is used. The bottom comprises projecting petal-shaped feet, separated by convex wall portions, called hollows or valleys, which extend radially from the center of the bottom. The feet are intended to keep the container upright on the surface, while the valleys are intended to absorb the stresses (thermal, mechanical) exerted by the contents, particularly during filling.

These problems are clearly explained in French patent FR 2 822 804, or its American equivalent U.S. Pat. No. 7,051, 889, which propose a container with petaloid bottom provided with a central cross-shaped impression intended to be deformed and accompany the partial retraction of the liquid during its cooling.

Although petaloid bottoms substantially improve the mechanical performance of containers, they create manufacturing difficulties due to their complex shape, which can hinder expansion of the material during blowing (the ability of the container to be formed by blowing is called "blowability"). Indeed, the material tends to congeal upon contact with the mold at the impression of the valleys, which are the first to be reached. The subsequent expansion of the material in the impressions of the feet is therefore slowed, and at the end, undesired variations in the thickness of material between the valleys and feet are noted. In some cases, an excess stretching in the feet is observed, which results in a whitening of the material.

It would therefore be desirable to reduce the width (measured perpendicularly to the radial direction) of the valley, in order to minimize the surface area of first contact with the material and thus improve the blowability of the container.

However, at the same time, it is desirable to widen the valleys in order to increase the strength of the bottom.

Furthermore, it is desirable to slope the walls (or flanks) of the feet as much as possible in order to facilitate the expansion of the material in the corresponding impressions, thus improving the blowability of the container.

But, at the same time, it is desirable to make these walls as vertical as possible in order to increase the rigidity of the bottom, because walls that are sloped too much increase the risk of reversing the bottom under the effect of the stresses mentioned above.

Thus, the dimensioning of the bottom, and more particularly of the feet and valleys, is subject to a set of specifications whose requirements are contradictory. The valleys must be rather wide and the feet rather vertical to confer the required rigidity to the bottom, while the valleys must be narrow enough and the feet sloped enough to confer good blowability to the container.

Of course, a compromise could be sought using a systematic series of tests/results. But such a series is long, tedious and expensive because it requires the production of many prototypes. Furthermore, the results are not necessarily guaranteed for all applications.

An objective of the invention is therefore to propose a new container whose bottom satisfactorily meets the contradictory requirements of rigidity and blowability.

To that end, the invention proposes a container of thermoplastic material produced by blowing or stretch blowing of a blank, said container comprising a petaloid bottom provided with projecting feet separated by hollow valleys that extend radially from a central zone of the bottom, each foot having two flanks, each of which laterally borders a valley, each foot being provided, on each of its flanks, with a cheek that projects laterally from the side of the valley.

The cheeks contribute to making the feet vertical on either side of the valleys, which increases the rigidity of the bottom and makes it mechanically more resistant to the thermal and/or mechanical stresses exerted by the contents, for example during hot filling, or when the contents are a carbonated liquid.

According to one embodiment, each cheek is substantially flat and forms a shallow angle with a median radial plane of the valley. More specifically, for example, the cheek forms an angle of between 10° and 20° with this median plane, and preferably about 15°.

Each flank is also sloped with respect to a median plane of the valley, the cheek forming an angle of more than 0° and less than 20° with the flank.

Each flank and the cheek projecting therefrom preferably have a common edge that extends to the junction with the valley.

For example, the cheek has a substantially triangular contour; on at least one edge, it connects to the flank by a fillet with double curvature.

Moreover, according to a particular embodiment, the bottom comprises, in the valleys, stiffeners in the form of radial ribs projecting outward, which reinforce the bottom and which extend for example from near a central zone of the bottom to near the periphery thereof.

Other objects and advantages of the invention will be seen from the following description, with reference to the appended drawings in which.

Figure 1:
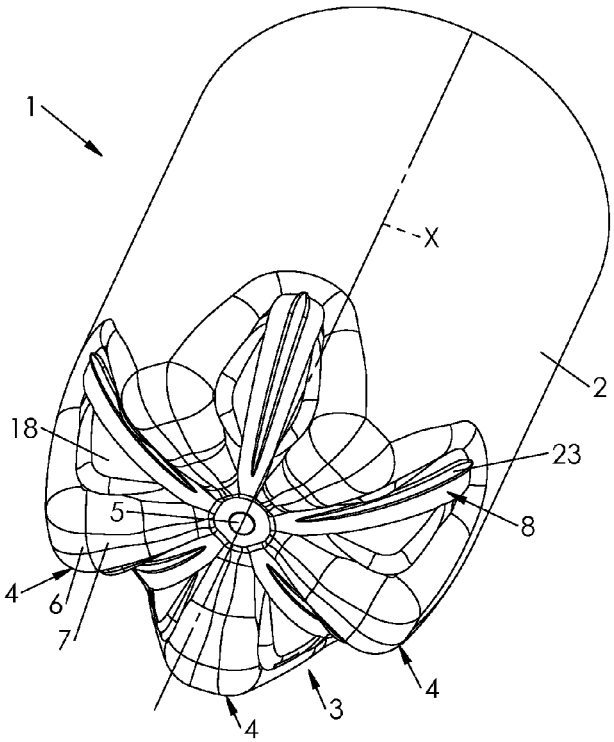
FIG. 1 is a perspective view from below of a container according to the invention.

Represented in perspective in FIG. 1 is the lower part of a container 1—in this instance a bottle—produced by blowing or stretch blowing of a preform made of thermoplastic material, for example polyethylene terephthalate (PET).

The container 1 extends along a principal axis X and comprises a sidewall 2 called body, and a bottom 3 that closes the body 2 at the lower end thereof.

The bottom 3 is petaloid, and comprises a series of feet 4 formed by excrescences projecting outward from the container 1, and which extend from a disc-shaped central zone 5 of the bottom 3, where the material remains substantially amorphous, towards the periphery of the bottom 3.

Figure 4:
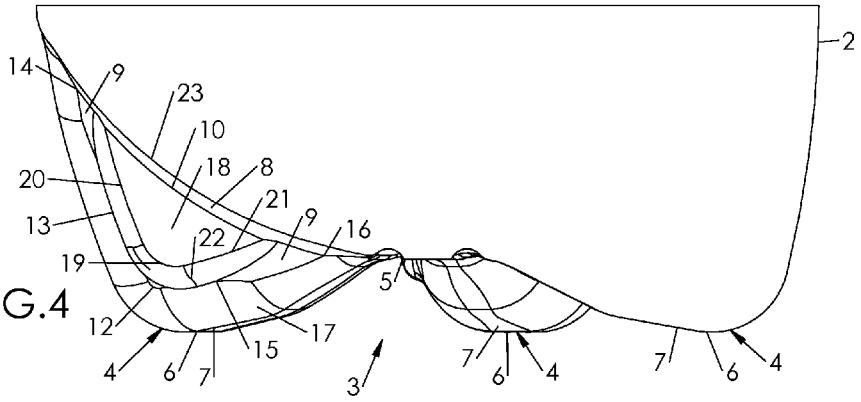
FIGS. 4, 5 and 6 are cross-sectional views of the bottom, respectively along lines IV-IV, V-V and VI-VI of FIG. 3; for greater clarity, the background lines showing the interior of the bottom have been deleted.

The most prominent part or top 6 of the feet 4, which at the same time is the widest part and forms a seat for the container 1, by which said container can rest on a flat surface (for example a table), is located near the periphery of the bottom 3. Each foot 4 has an end face 7 that extends at a slight slope and becomes thinner from the top 6 toward the central zone 5 of the bottom 3, so that the foot 4 has a substantially triangular profile (FIG. 4) in radial cross-section.

Figure 2:
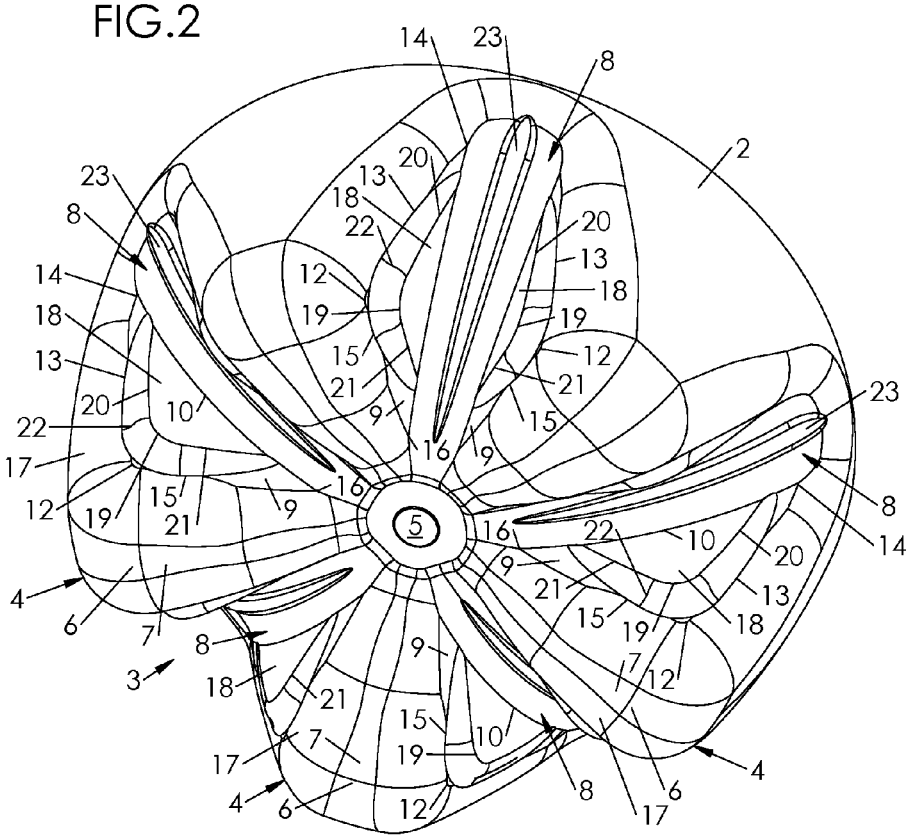
FIG. 2 is a view in larger scale of the bottom of the container of FIG. 1.
Figure 3:
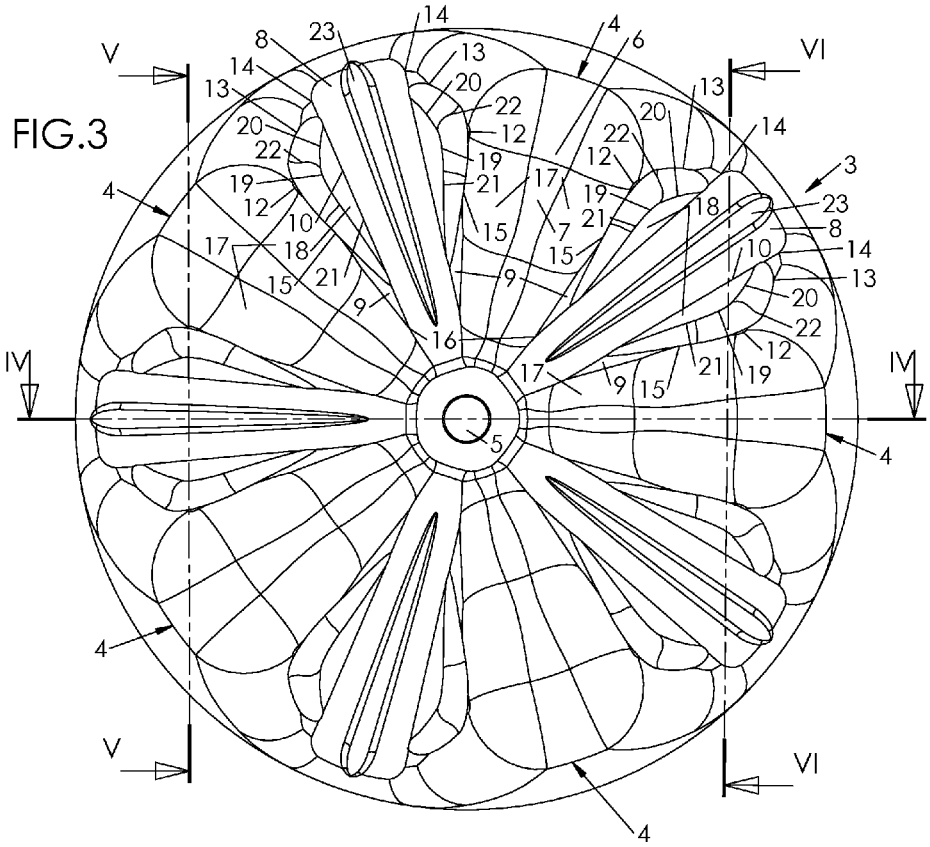
FIG. 3 is a plan view from below of the bottom of FIG. 2.

As can be clearly seen in FIGS. 1 to 3, the feet 4 are separated by valleys 8 formed by narrow strips of material that extend radially in star shape from the central zone 5 of the bottom 3 to the periphery thereof. The valleys 8 are convex outward in radial cross-section (see at left in FIG. 4) and slightly concave outward in transverse cross-section (i.e., along a plane perpendicular to the radial direction, see FIG. 5).

FIGS. 1 to 3 show that the number of feet 4 is equal to the number of valleys 8. In the example illustrated in the drawings, the bottom 3 comprises five feet 4 and five valleys 8, alternating regularly and distributed in star shape. This number constitutes a good compromise. However, it could be smaller (but equal to or more than three), or greater (but preferably equal to or less than seven).

Each foot 4 has two substantially flat flanks 9 each laterally bordering a valley 8. More specifically, the flanks 9 of a foot 4 are turned back to back, opposite each other, while a valley 8 is laterally bordered by two flanks 9 facing two adjacent feet 4.

Each flank 9 follows the general contour of the foot 4 (in this instance triangular) and extends from a curvilinear upper edge 10, along which the flank 9 connects to the valley 8 by a fillet 11 of substantially circular cross-section (FIG. 5), up to a top 12 situated near the top 6 of the foot 4. The flank 9 is bounded by two edges substantially at right angles, i.e., an outer edge 13, substantially parallel to the body 2 of the container 1 and which extends from an outer end 14 of the upper edge 10 to the top 12, and an inner edge 15, substantially parallel to the end face 7 of the foot 4 and which extends from an inner end 16 of the upper edge to the top 12.

Figure 6:
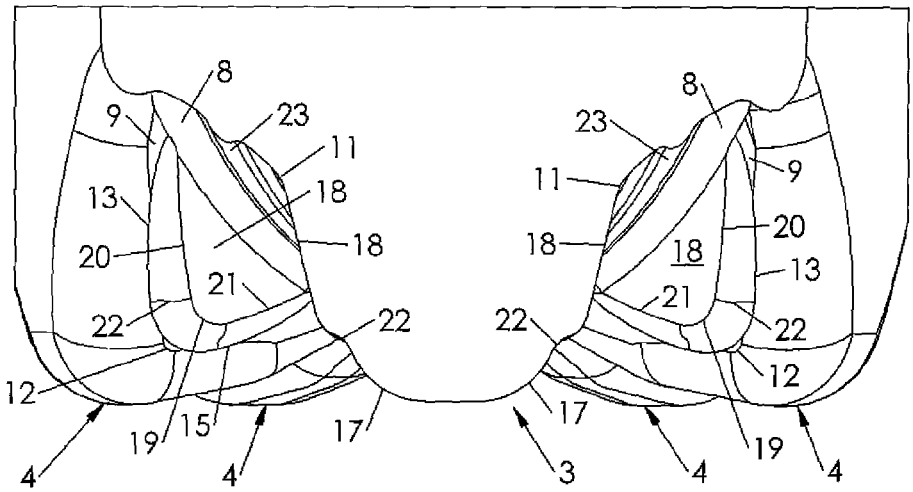

As represented in FIGS. 3 and 6, the flanks 9 are not vertical (because the bottom 3 would then be difficult if not impossible to blow), but are sloped, opening out from the valley 8 toward the top 12, so that each foot 4 has, in cross-section in transverse plane (see FIG. 6), a V-shaped profile with rounded top, or in other words, U-shaped with splayed legs.

Each flank 9 is sloped with respect to a radial plane P cutting the valley 8 along a median line into two identical parts, and has with respect to said plane P a relatively large angular opening A, of between 20° and 30°. Preferably, as in the example illustrated in FIG. 5, this angular opening A is about 25°.

Each flank 9 is connected to the end face 7 of the foot 4 by fillets 17 having an arc-of-circle profile with a large radius.

Furthermore, as can be seen in all of the figures, each foot 4 has, on each of its flanks 9, a cheek 18 that protrudes laterally from the side of the valley 8.

The cheek 18 is substantially flat and has a contour (in this instance triangular) similar to that of the flank 9 from which it protrudes. The cheek 18 extends from a curvilinear upper edge, coinciding with the upper edge 10 of the flank, to a top 19 located near the top 12 of the flank 9. It can be seen in FIGS. 4 and 6 that the contour of the cheek 18 is substantially homothetic with that of the flank 9, the surface of the cheek 18 being smaller than that of the flank 9. The cheek 18 is bordered by two edges substantially at right angles, i.e., an outer edge 20 and an inner edge 21, which are joined at the top 19 and are substantially parallel respectively to the outer edge 13 and to the inner edge 15 of the flank 9 while being offset from them toward the interior of the cheek 18.

Figure 5:
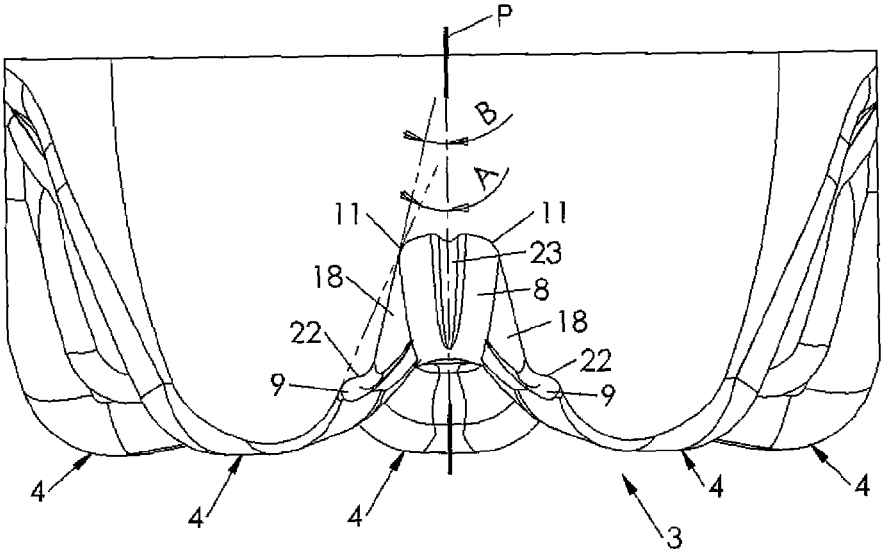

As illustrated in FIG. 5, the cheek 18 does not extend in a plane parallel to the flank 9 from which it protrudes, but is sloped with respect thereto. More specifically, the cheek 18 has, with respect to the radial plane P, a small angular opening B, less than 20° and preferably between 10° and 20°. In the example illustrated in FIG. 5, the angular opening B is about 15°. In other words, assuming, as described above, the flank 9 is sloped at an angle of between 20° and 30° with respect to the plane P, the cheek 18 is sloped, with respect to the flank 9 itself, by an angle A-B of more than 0° but less than 20°.

The outer edge 20 and the inner edge 21 of the cheek 18 are connected at the corresponding edges 13, 15 of the flank 9 by fillets 22 of inverse double curvature (or double radius) that are shown in the figures (clearly visible in FIGS. 2 and 6) by wavy lines.

The strong slope of the flanks 9 allows the material, during blowing, to easily reach the bottom of the impression of the feet 4 (corresponding to the tops 6), thus benefiting the blowability of the bottom 3.

It will be noticed that this blowability is also facilitated by the large radii of the fillets 17.

Moreover, the presence of the cheeks 18 favors the blowability of the bottom 3 because, due to their particular shape, they deepen the impression of the mold at the level of the flanks 9, thus delaying the contact of the material with the mold at the level of the cheeks 18 during the blowing of the container. Consequently, the other parts of the bottom 3 (particularly the junction between the valleys 8 and the flanks 9) can be developed more easily than with known petaloid bottoms. Furthermore, the presence of the cheeks 18 makes it possible to avoid this good blowability from being obtained to the detriment of the rigidity of the bottom 3. Indeed, the function of the cheeks 18 is to make the feet 4 locally vertical on either side of the valleys 8 and thus resisting the collapse of the bottom 3 under the effect of mechanical and/or thermal stresses exerted on the container 1 (for example during hot filling or in the case of a carbonated liquid).

The fillets 22 with inverse double curvature contribute dynamically to this function. Indeed, under the effect of the mechanical and/or thermal stresses, the fillets 22 tend to creep and to expand while flattening, which causes a deployment (in other words a verticalization) of the cheek 18 toward the valley 8.

According to a preferred embodiment, illustrated in the drawings, the bottom 3 is further reinforced by means of stiffeners 23 in the form of radial ribs that protrude outward from the container 1, at the bottom and along the valleys 8. More specifically, each stiffener 23 extends along a median line of a valley, from the central zone 5 (or close to it) to the periphery (or close to it) of the bottom 3.

In plan view (FIG. 3), each stiffener 23 is spindle-shaped, widening from the central zone 5 toward the periphery; in radial cross-section (FIG. 4), the stiffener follows the convex arc-shaped contour of the valley 8; in transverse cross-section (FIGS. 5 and 6), the stiffener has a profile rounded toward the exterior of the container.

The function of the stiffeners 23 is to make the bottom 3 rigid. Under the effect of the mechanical and/or thermal stresses exerted on the container (for example during hot filling or in the case of a carbonated liquid), the stiffeners 23 tend to creep while expanding and flattening, which causes a widening of the valleys 8, resulting in a verticalization of the feet 4, which, as indicated before, resists the collapse of the bottom 3.

To achieve this objective, it is not necessary for the stiffeners 23 to occupy transversely the full width of the valleys 8. It is sufficient for the stiffeners 23 to occupy only part of the width of the valleys 8. Thus, according to a preferred embodiment illustrated in the figures and more particularly visible in FIG. 3, the stiffeners 23 extend transversely over about one-third of the width of the valleys 8.

Furthermore, the valleys 8 are not necessarily all provided with stiffeners 23; only part of them could be so provided (for example every other one when the bottom 3 has an even number of valleys 8).

The invention claimed is:

1. A container of thermoplastic material produced by blowing or stretch blowing a blank, said container comprising a petaloid bottom provided with projecting feet separated by hollow valleys that extend radially from a central zone of the petaloid bottom, each projecting foot having two substantially flat flanks, each flank of which laterally borders a side of one of the hollow valleys, and each projecting foot is provided, on each flank of the projecting foot, with a corresponding cheek that projects laterally from the flank to a respective hollow valley that is laterally bordered by the flank; and wherein each cheek has at least one edge where the cheek connects to the flank from which the cheek protrudes by a fillet with double curvature.

2. The container according to claim 1, characterized in that each cheek forms an angle of between 10° and 20° with a median radial plane of the respective hollow valley.

3. The container according to claim 2, characterized in that each flank is sloped with respect to said median radial plane of the respective hollow valley, and in that each cheek forms an angle of more than 0° and less than 20° with the respective flank of the cheek.

4. The container according to claim 1, characterized in that each flank and the cheek projecting therefrom has a common edge with the respective hollow valley that the flank and cheek border.

5. The container according to claim 1, characterized in that each cheek has a substantially triangular contour.

6. The container according to claim 1, characterized in that the bottom comprises, in the hollow valleys, stiffeners in the form of radial ribs projecting outward.

7. The container according to claim 6, characterized in that said stiffeners extend from near the central zone of the petaloid bottom to near a periphery thereof.

8. The container according to claim 1, characterized in that each cheek forms an angle of about 15° with a median radial plane of the respective hollow valley.

* * * * *